US006880531B2

(12) United States Patent
Bayerle et al.

(10) Patent No.: US 6,880,531 B2
(45) Date of Patent: Apr. 19, 2005

(54) METHOD FOR INJECTING FUEL DURING THE STARTING PHASE OF AN INTERNAL COMBUSTION ENGINE

(75) Inventors: Klaus Bayerle, Obertraubling (DE); Steffen Gessner, Regensburg (DE); Harry Schüle, Neunburg V. Wald (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/432,139

(22) PCT Filed: Nov. 15, 2001

(86) PCT No.: PCT/DE01/04313

§ 371 (c)(1),
(2), (4) Date: May 16, 2003

(87) PCT Pub. No.: WO02/40847

PCT Pub. Date: May 23, 2002

(65) Prior Publication Data

US 2004/0020472 A1 Feb. 5, 2004

(30) Foreign Application Priority Data

Nov. 16, 2000 (DE) ..... 100 56 862

(51) Int. Cl.[7] ..... F02M 51/00
(52) U.S. Cl. ..... 123/490; 123/480
(58) Field of Search ..... 123/490, 491, 123/480, 478, 299

(56) References Cited

U.S. PATENT DOCUMENTS

| | | | | |
|---|---|---|---|---|
| 4,998,522 A | | 3/1991 | Achleitner | |
| 5,140,955 A | * | 8/1992 | Sono et al. | 123/90.15 |
| 5,450,829 A | * | 9/1995 | Beck | 123/435 |
| 5,595,161 A | | 1/1997 | Ott et al. | |
| 6,032,640 A | * | 3/2000 | Evans | 123/295 |
| 6,213,089 B1 | * | 4/2001 | Cheng | 123/300 |
| 6,612,292 B1 | * | 9/2003 | Shirakawa | 123/501 |

FOREIGN PATENT DOCUMENTS

| | | |
|---|---|---|
| DE | 197 41 966 A1 | 4/1999 |
| EP | 0 371 158 A1 | 6/1990 |
| JP | 60069247 | 4/1985 |

* cited by examiner

*Primary Examiner*—John T. Kwon
(74) *Attorney, Agent, or Firm*—Cohen, Pontani, Lieberman & Pavane

(57) ABSTRACT

During the starting phase of an internal combustion engine with fuel injection so-called pilot injectors (I) are used to establish a film on the cylinder walls and at the same time to provide an ignitable mixture for the first combustion. At this point in time the cam shaft and the crankshaft are not yet synchronized and the position of the pistons is unknown. The method according to the invention allows determination of the sequence of the pilot injectors (I) depending on the possible relative positions during the stop periods of the internal combustion engine, said positions being known beforehand.

7 Claims, 3 Drawing Sheets

METHOD FOR INJECTING FUEL DURING THE STARTING PHASE OF AN INTERNAL COMBUSTION ENGINE

PRIORITY CLAIM

This is a U.S. national stage of application No. PCT/DE01/04313, filed on Nov. 15, 2001. Priority is claimed on that application and on the following application: Country: Germany, Application No.: 100 56 862.9, Filed: Nov. 16, 2000.

BACKGROUND OF THE INVENTION

1. Field of the Invention

The present invention relates to a method for injecting fuel into a multi-cylinder internal combustion engine.

2. Description of the Prior Art

When starting a gasoline engine, it is known to supply each of the cylinders once with what is known as a pilot injection in order to wet the cylinder walls and simultaneously provide an ignitable mixture for the first combustion. Since at this point in time the camshaft and the crankshaft are not yet synchronized and the position of the pistons is unknown, a selective pilot injection strategy is required in order to minimize the emission of non-combusted fuel and hence the pollutant emissions during the start.

In a method known from EP 0 371 158 B1, the cylinders are divided into a first and a second cylinder group according to the two different levels of the camshaft signal. The cylinders of the first group are supplied simultaneously with the pilot injections immediately after a start detection (group injection), while the cylinders of the second group are supplied with the pilot injections with a time delay, and in fact either in a preset sequence or in a normal sequential sequence depending on whether camshaft and crankshaft have already been synchronized.

It has now proved that in this method, in 50% of all starts, not all pilot injections for the cylinders of the first group reach combustion, since some of the pilot injections coincide with an open inlet valve or an inlet valve that is just closing, depending on the stationary position of the internal combustion engine and the position of the inlet valves. Such a situation should be avoided, bearing in mind the increasingly strict statutory regulations on exhaust emissions. An excess fuel emission of this type could be avoided by not releasing the pilot injections until the exact position and relationship between crankshaft and camshaft are known, so that then a "sequential start" might be performed. The result would be a delayed start, however.

SUMMARY OF THE INVENTION

The object of the present invention is to define a method for injecting fuel into a multi-cylinder internal combustion engine that enables an emission-optimized quick start of the internal combustion engine.

The method according to the invention for injecting fuel is directed to a multi-cylinder internal combustion engine having a crankshaft, a plurality of cylinders, at least one injection valve for each of the plural cylinders, inlet valves for said plural cylinder, a camshaft for operating the inlet valves, the camshaft rotating at half the speed of the crankshaft, a camshaft sensor generating a periodic camshaft signal, a crankshaft sensor genera a crankshaft signal representing a crankshaft angle and containing a synchronization pulse per crankshaft revolution, and a central control unit controlling the injection valves such that the injection valves inject one pilot injection into each of said plural cylinders during a starting phase and the injection valves inject amounts of fuel determined by central control unit in a normal sequential injection mode. The internal combustion engine comes to a stop, after being turned off with the clutch disengaged, at one of a number of discrete stationary angle positions equal to the number of cylinders. The method includes the steps of saving the discrete stationary angle positions in the central control unit, and supplying the cylinders with the pilot injections one after the other in response to the camshaft signal and the saved discrete stationary angle positions.

The present invention is based on the finding that an internal combustion engine always comes to a stop at specific discrete positions after switching off with the clutch disengaged, where the number of discrete positions over two crankshaft revolutions (760°) always equals the number of cylinders. In the case of n cylinders this is thus n stationary angle positions.

When the internal combustion engine is started, these n stationary angle positions are initially unknown. Using the camshaft signal, however, the number of unknown stationary angle positions can be reduced to n/2. Hence in the method according to the invention, depending on the camshaft signal and the saved stationary angle positions, one cylinder can be selected as the first to be supplied with a pilot injection, while the remaining pilot injections are released later. Unlike the known method described above, the first cylinders are thus not supplied simultaneously with the pilot injections, but always delayed in time relative to each other.

Preferably, depending on the camshaft signal, which enables each cycle to be divided into two segments corresponding to two consecutive crankshaft revolutions, the stationary angle positions are divided into two groups, and that group containing the current stationary angle position at which the internal combustion engine has stopped is determined. Advantageously, only that cylinder of the first group whose inlet valve on discharge of the first pilot injection is definitely closed or at least predominantly closed, is the first supplied with a pilot injection.

In order to determine the sequence of the next pilot injections, the angle separation between the angle position at which the first pilot injection is discharged and the angle position of the first synchronization pulse is advantageously compared with the angle separation between two adjacent saved stationary angle positions, and the sequence of the next pilot injections determined as a function of this comparison.

The method according to the invention ensures that all pilot injections are actually involved in the combustion, so that the fuel emissions, in particular the HC emissions, fall to the level of a sequential start. Early fuel injection is still possible, however, so that the method according to the invention enables a faster start compared with a sequential start procedure.

BRIEF DESCRIPTION OF THE DRAWINGS

The method according to the invention is described in more detail with reference to the drawings, in which.

DETAILED DESCRIPTION OF THE PRESENTLY PREFERRED EMBODIMENTS

Figure 1:
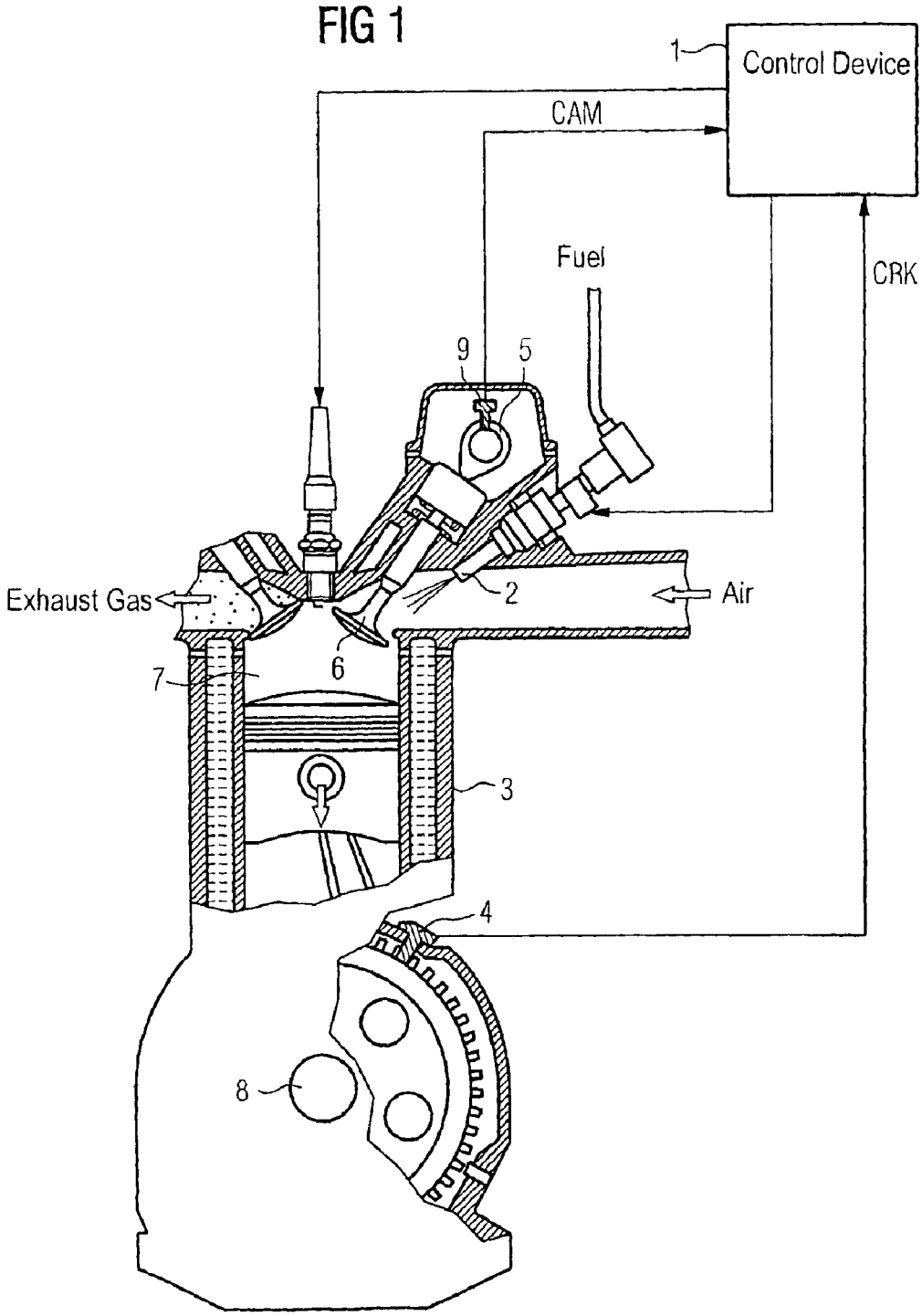
FIG. 1 is a schematic cross-sectional diagram of an internal combustion engine in the form of a gasoline engine with gasoline injection.

FIG. 1 shows a schematic cross-section through an internal combustion engine (ICE), which, in the exemplary embodiment described, is designed for illustrative purposes as a four-cylinder gasoline engine with gasoline injection.

In the usual way, a central electronic control device 1 controlling the ignition, fuel injection and other processes of the internal combustion engine is assigned to the internal combustion engine 3. At least one inlet valve 6 and at least one injection valve 2 are assigned to each cylinder 7. The injection valve 2 injects fuel into the suction pipe immediately in front of or onto the valve disk of the inlet valve 6.

The crankshaft 8 is assigned a crankshaft sensor 4 having a toothed encoder wheel that generates a crankshaft signal CRK (see lower half of FIGS. 2 and 3) representing the crankshaft angle. The camshaft 5, which controls the inlet valve 6 and which rotates at half the speed of the crankshaft 8, is assigned a camshaft sensor 9 for generating a camshaft signal CAM (see lower half of FIGS. 2 and 3). The camshaft 5 can be fixed to the crankshaft 8 at a permanent angle or else at an adjustable angle to it.

Figure 2:
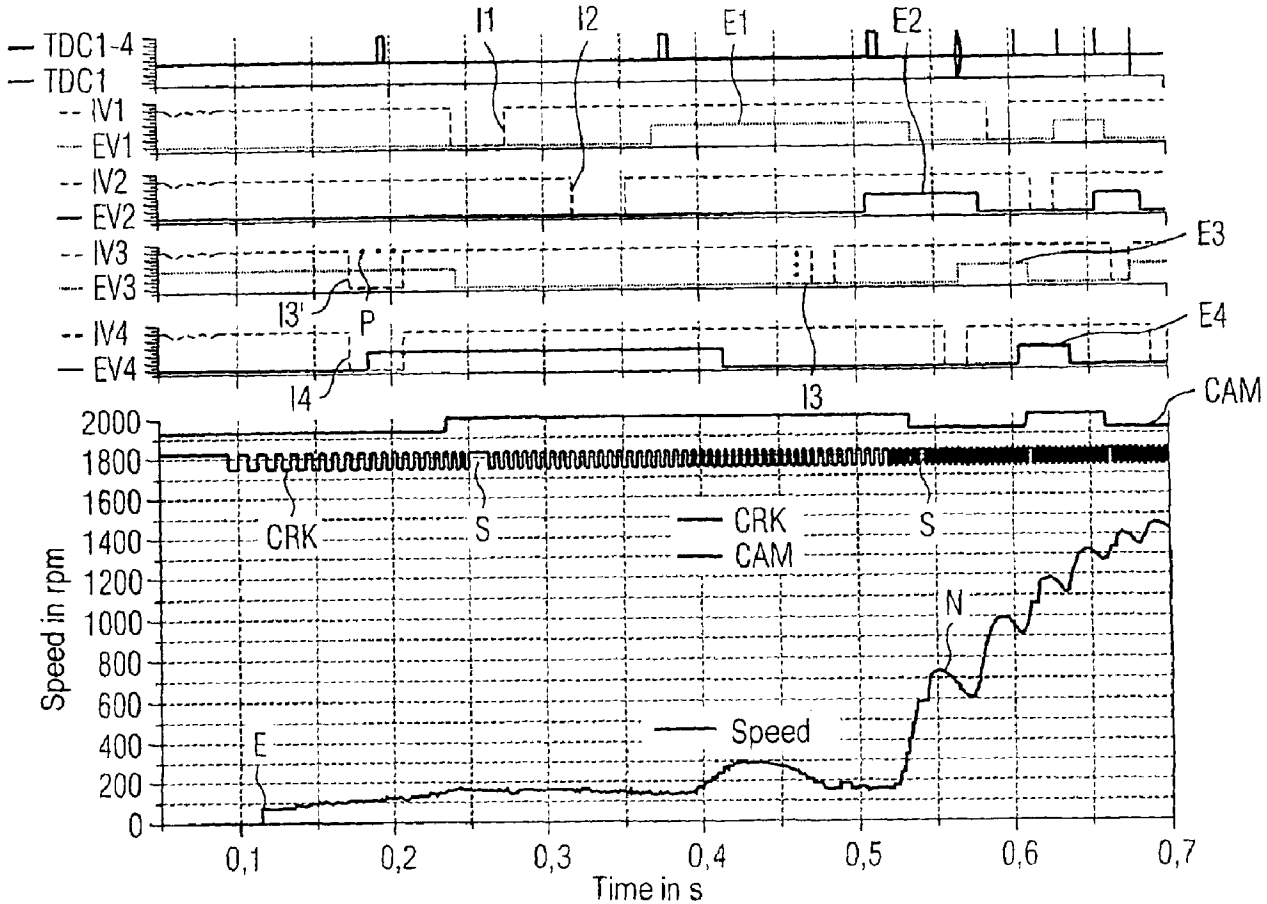
FIG. 2 is a graph in which rotational speed, camshaft, crankshaft, injection-valve and inlet-valve signals are plotted over time.
Figure 3:
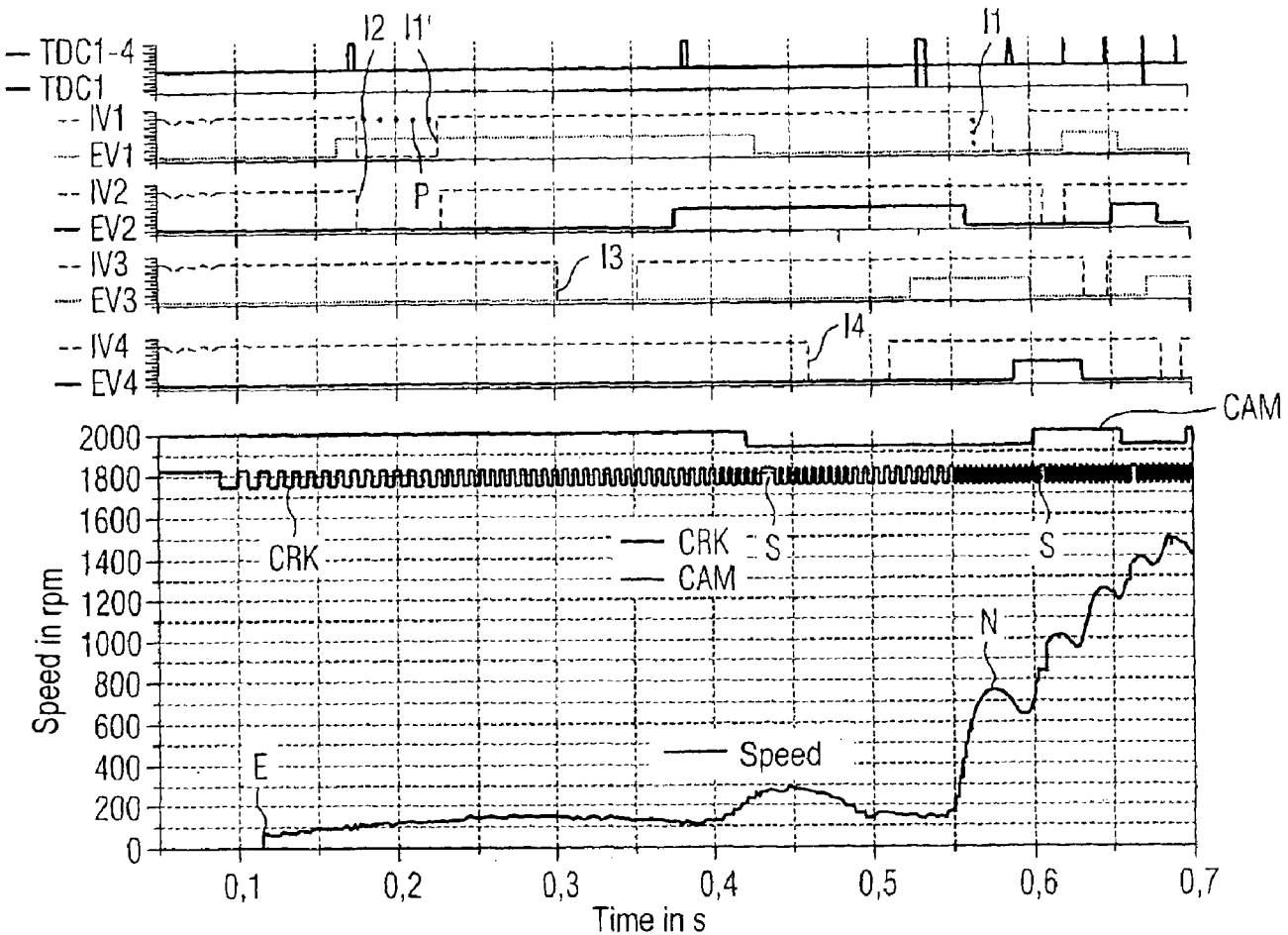
FIG. 3 is another graph in which rotational speed, camshaft, crankshaft, injection-valve and inlet-valve signals are plotted over time.

The crankshaft signal CRK, the camshaft signal CAM and the rotational speed N of the internal combustion engine are each plotted over time in the lower half of FIGS. 2 and 3. Each pulse of the crankshaft signal CRK corresponds to one tooth of the encoder wheel, where a double tooth-gap after every 60 teeth acts as synchronization pulse S for each full revolution of the crankshaft 8. The camshaft signal CAM has two different levels, which are assigned to two consecutive revolutions of the crankshaft. The camshaft signal CAM and the crankshaft signal CRK with its synchronization pulses S enable the position of the camshaft to be assigned uniquely in the cycle.

The camshaft signal can also take other pulse and level shapes; it should be ensured, however, that the camshaft signal enables every cycle to be divided into two segments (of 360°) corresponding to two consecutive crankshaft revolutions (720°).

During normal operation of the internal combustion engine, the injection valves 2 can thus be controlled and operated in the usual sequential injection mode using the crankshaft signal and the camshaft. At starting, however, the crankshaft position, and hence the position of the pistons, is still not known, and the camshaft and crankshaft may also not be synchronized yet. Injection in sequential injection mode is hence not possible.

Tests have now shown that an internal combustion engine always comes to a stop at discrete positions after switching off with the clutch disengaged. In a four-cylinder internal combustion engine these are precisely four positions over every 760° rotation of the crankshaft. For the toothed encoder wheel of the crankshaft sensor 4, the resultant positions are always, for example, either 20 (±7) teeth or 50 (±7) teeth before a synchronization pulse S. The angle separation between these positions thus equals 180° (±42°). In a similar way, for a six-cylinder internal combustion engine, the resultant positions for the toothed encoder wheel of the crankshaft sensor are e.g. 5 or 25 or 45 teeth before the next synchronization pulse S; the angle separation between the positions then equals 120°. As a general rule, the number of stationary angle positions at which the internal combustion engine comes to a stop equals the number of cylinders. Furthermore, it has proven that as the number of cylinders increases, the stationary angle positions become more discrete.

The facts described above are exploited in the method according to the invention to develop an optimum strategy for the discharge of pilot injections during the starting phase. This pilot injection strategy is explained first with reference to FIG. 2.

In the lower half of FIG. 2, the rotational speed N of the internal combustion engine is plotted over time together with the crankshaft signal CRK and the camshaft signal CAM. In the top half of FIG. 2, for the four cylinders 1 to 4 of the four-cylinder internal combustion engine, the control signals IV1–IV4 for the four injection valves are plotted over time, where the four pilot injections I are labeled with I1–I4. In addition, the control signals EV1–EV4 for the four inlet valves are plotted over time, where the opening pulses for opening the inlet valves are labeled with E1–E4. Furthermore, the pulses for the top dead point (TDC1–TDC4) of the four cylinders and the top dead point (TDC1) of cylinder 1 are shown in the two topmost lines respectively of FIG. 2.

As indicated in FIG. 2 in connection with the rotational speed, start detection E is provided for the start of the internal combustion engine. At this point in time, the camshaft signal CAM is either at high or low level, and in the example of FIG. 2 it is at low level. Using this, the cylinders 1 to 4 can be divided—e.g. as in the method according to EP 0 371 158 B1 described in the introduction—into two groups (in the example of FIG. 2 into a first group containing the cylinders 3, 4 and a second group containing the cylinders 1, 2). Furthermore, it is also known from this whether the internal combustion engine has come to a stop in the first two stationary angle positions or in the second two stationary positions. Expressed another way, the number of unknown stationary angle positions reduces to two.

In the previously known method described in the introduction, the two cylinders 3, 4 of the first cylinder group are supplied simultaneously with the pilot injections in a preset angle separation from the start detection E (for example after eight detected and valid teeth of the crankshaft sensor), as indicated by the pilot injections I3' and I4'. In this case, however, the pilot injection I3' would be discharged shortly before closure of the associated inlet valve EV3, which would lead to the fuel-air mixture being too rich and to the emission of non-combusted fuel.

Thus, according to the method according to the invention, after the start detection E, only that cylinder whose inlet valve is definitely closed or predominantly closed is supplied with the pilot injection; in the example of FIG. 2 this is the cylinder 4 having the pilot injection I4. The pilot injection I3', on the other hand, is not discharged at this point in time, as indicated by a dotted line P.

As already mentioned, at the time of the discharge of the first pilot injection I4 it is not yet known whether the internal combustion engine has come to a stop in the first or second stationary angle position (e.g. 50 or 20 teeth before the first synchronization pulse S). In the example of FIG. 2, the crankshaft has stopped 20 teeth before the first synchronization pulse S. If, therefore, the first synchronization pulse S has already occurred by 28 teeth after the start detection E (i.e. 20 teeth after the first pilot injection I4, which is the case in the example of FIG. 2), then it can be identified that the crankshaft has stopped 20 teeth before the synchronization pulse S. As soon as the synchronization pulse S has occurred, the internal combustion engine is synchronized, and hence a defined sequence of the pilot injections following the synchronization pulse S can be determined by the central control unit 1.

As can be seen from the graph in FIG. 2, this results in all the pilot injections I1 to I4 being discharged before the opening of the associated inlet valve E1 to E4 or at least at the start of the opening process (inlet valve EV4). Thus, all the pilot injections can be involved in the combustion, so that the fuel emissions caused by non-combusted emitted fuel are no greater than for a start using sequential injection mode. Since ignition in the four cylinders is enabled at the earliest possible point in time, this pilot injection strategy allows a quick start of the internal combustion engine.

The graph in FIG. 3 corresponds to that in FIG. 2, except that the camshaft signal CAM is at high level at the time of the start detection E, and the internal combustion engine has stopped 50 (±7) teeth of the crankshaft sensor before the first synchronization pulse S. Since at the time of the start detection E, the camshaft signal CAM is at a high level, the first cylinder group is made up of the cylinders 1, 2 and the second cylinder group of the cylinders 3, 4. In this case (after eight detected and valid teeth of the crankshaft sensor) only the cylinder 2 is supplied with the pilot injection I2, while the pilot injection I1' for the cylinder 1 provided in the previously known method is omitted. Since in this example a synchronization pulse S has still not occurred by 28 teeth after the start detection E, the next pilot injection or pilot injections are discharged at the preset angle separation from the angle position at which the first pilot injection was discharged. As soon as the first synchronization pulse S has occurred, the order of the following pilot injections can again be determined by the central control unit 1 in sequential injection mode.

What is claimed is:

1. A method for injecting fuel into a multi-cylinder internal combustion engine having a crankshaft, a plurality of cylinders, at least one injection valve for each of the plural cylinders, inlet valves for said plural cylinder, a camshaft for operating the inlet valves, the camshaft rotating at half the speed of the crankshaft, a camshaft sensor generating a periodic camshaft signal, a crankshaft sensor generating a crankshaft signal representing a crankshaft angle and containing a synchronization pulse per crankshaft revolution, and a central control unit controlling the injection valves such that the injection valves inject one pilot injection into each of said plural cylinders during a starting phase and the injection valves inject amounts of fuel determined by central control unit in a normal sequential injection mode, wherein the internal combustion engine comes to a stop after being turned off with the clutch disengaged at one of a number of discrete stationary angle positions equal to the number of cylinders, said method comprising the steps of:

saving the discrete stationary angle positions in the central control unit; and supplying the cylinders with the pilot injections one after the other in response to the camshaft signal and the saved discrete stationary angle positions.

2. The method of claim 1, wherein the camshaft signal divides each cycle of the internal combustion engine into two segments corresponding to two consecutive crankshaft revolutions, said method further comprising the steps of dividing the discrete stationary angle positions into two groups and determining the group including the current stationary angle position at which the internal combustion engine has stopped in response to the camshaft signal.

3. The method of claim 2, wherein said step of dividing the discrete stationary angle positions includes dividing the plural cylinders into a first group to be injected and a second group to be injected and selecting a cylinder from the first group as the first cylinder to be injected with the pilot injection.

4. The method of claim 3, wherein said step of selecting a cylinder comprises selecting the cylinder from the first group if the injection valve associated with the cylinder is one of closed and predominantly closed.

5. The method of claim 4, further comprising the steps of comparing a first angle between the crankshaft angle position at which the first pilot injection injected and the angle position of the first synchronization pulse of the crankshaft signal to a second angle between two adjacent saved stationary angle positions and determining a sequence of the subsequent pilot injections in response to the comparison.

6. The method of claim 5, further comprising the step of defining the sequence of remaining pilot injections in sequential mode after the occurrence of the first synchronization pulse in the crankshaft signal.

7. The method of claim 1, wherein said step of supplying comprises defining the sequence of remaining pilot injections in sequential mode after the occurrence of the first synchronization pulse in the crankshaft signal.

* * * * *